US006286430B1

(12) United States Patent
Salort

(10) Patent No.: US 6,286,430 B1
(45) Date of Patent: Sep. 11, 2001

(54) DEVICE FOR THE PYROTECHNIC CUTTING OF NON-METALLIC PARTS

(75) Inventor: Cédric Salort, Ville d'Avray (FR)

(73) Assignee: Aerospatiale Société Nationale Industrielle, Paris (FR)

( * ) Notice: Subject to any disclaimer, the term of this patent is extended or adjusted under 35 U.S.C. 154(b) by 0 days.

(21) Appl. No.: 09/323,832

(22) Filed: Jun. 2, 1999

(30) Foreign Application Priority Data

Jun. 2, 1998 (FR) ..... 98 06899

(51) Int. Cl.[7] ..... F42B 15/10; F42B 3/00; B64D 25/02

(52) U.S. Cl. ..... 102/378; 102/312; 102/313; 102/333; 244/122 AF

(58) Field of Search ..... 244/122 AF; 102/312, 102/313, 333, 378

(56) References Cited

U.S. PATENT DOCUMENTS

| | | | | |
|---|---|---|---|---|
| 3,453,960 | | 7/1969 | Qualls | 102/495 |
| 3,486,410 | | 12/1969 | Drexelius et al. | 89/1 |
| 3,698,281 | | 10/1972 | Brandt et al. | 89/1 B |
| 3,778,010 | * | 12/1973 | Potts et al. | 244/122 AF |
| 4,090,447 | * | 5/1978 | Johnsen | 102/313 |
| 4,314,500 | | 2/1982 | Hoppe | 89/1 B |
| 4,333,381 | * | 6/1982 | Boeglin et al. | 244/122 X |
| 4,512,538 | * | 4/1985 | Devienne | 244/122 X |
| 4,685,376 | | 8/1987 | Noel et al. | 89/1.14 |
| 5,003,880 | * | 4/1991 | Gut et al. | 102/313 X |
| 5,104,067 | * | 4/1992 | McIntyre et al. | 244/122 AF |
| 5,665,933 | * | 9/1997 | Persson | 102/333 |

FOREIGN PATENT DOCUMENTS

| | | |
|---|---|---|
| 0 246 958 | 11/1987 | (EP) . |
| 0 273 061 | 7/1988 | (EP) . |
| 2 598 769 | 8/1990 | (FR) . |

* cited by examiner

*Primary Examiner*—Peter A. Nelson
(74) *Attorney, Agent, or Firm*—Oblon, Spivak, McClelland, Maier & Neustadt, P.C.

(57) ABSTRACT

A pyrotechnic cutting device (14) is designed for directly cutting one or two parts (10) made form a nonmetallic material, such as a composite material. The device (14) comprises a pyrotechnic expansion tube (16), which acts on the part or parts (10) to be cut by means of a cutting member (32). This member can act in the manner of a punch or single or double shears. It can also be deformable or non-deformable. In the former case, the cutting member (32) can be integrated into the part (10) during its manufacture, particularly when said part is made from a composite material.

16 Claims, 3 Drawing Sheets

DEVICE FOR THE PYROTECHNIC CUTTING OF NON-METALLIC PARTS

BACKGROUND OF THE INVENTION

1. Field of the Invention

The present invention relates to a cutting device utilizing a pyrotechnic expansion tube for cutting at least one part, along a given cutting line.

Such a cutting device can more particularly be used in the aeronautical and space industries for the control, in a very short time of the separation of two structural elements, while ensuring the transmission of the sometimes high stresses and forces between the two elements, prior to cutting taking place.

2. Discussion of Background

Currently, when two metallic structures, having forces, stresses and loads passing therebetween, are to be irreversibly separated in a very short time and in a remotely controlled manner, pyrotechnic cutting devices integrated into the junction zone between the two structures, are often used.

When a clean cutting operation is desired to be carried out, so that with a minimum amount of dust is released, pyrotechnic expansion tubes are generally used.

The expression "pyrotechnic expansion tube" designates a tight, deformable metal tube, in which a detonating cord or fuse is passed therethrough. A flexible material, such as silicone rubber, is interposed between the detonating fuse and an envelope enveloping the detonating fuse. Prior to firing, the envelope has an oblong cross-section, e.g., in the form of an ellipse or flattened circle.

When the detonating fuse is fired, a shock wave, propagating at a very high velocity along the pyrotechnic expansion tube, deforms the envelope and tends to give the envelope a substantially circular cross-section.

Conventionally a pyrotechnic cutting device including a pyrotechnic expansion tube is used for cutting metallic parts. For this purpose, the pyrotechnic expansion tube is installed in a space between two metallic parts or between two portions of the same metallic part. The part or parts to be cut are previously machined, so as to have a reduced thickness zone along each desired cutting line. The expansion of the envelope, caused by the firing of the detonating fuse, leads to the cutting of the part or parts along the cutting line corresponding to the machined zone.

Devices for cutting one or two metallic parts by means of a pyrotechnic expansion tube are more particularly described in: U.S. Pat. No. 3,486,410; U.S. Pat. No. 3,453,960; U.S. Pat. No. 3,698,281; FR-A-2 598 796 and EP-A-0 273 061.

The structural elements used in the aeronautical and space industries are increasingly frequently made from non-metallic materials. In particular, the materials used are often composite materials, i.e., materials formed from long fibers arranged in the form of sheets superimposed in preferred orientations and embedded in a resin matrix.

When such non-metallic materials are used, it is not presently possible to directly cut the non-metallic materials with a pyrotechnic expansion tube, as is normally done with metallic structures.

Firstly, machining of a reduced thickness zone, in a non-metallic material and more particularly, in a composite material, the non-metallic material and/or the composite material being indispensable for localizing and limiting the cutting produced by the pyrotechnic expansion tube), is unacceptable. Thus, machining of a reduced thickness zone would most likely lead to unacceptably reducing the mechanical characteristics of the part to be cut prior to cutting by the pyrotechnic expansion tube, due to the long fibers of the composite material, giving the composite material its preferred characteristics, being cut.

Moreover, the cutting, of a non-metallic and particularly a composite material, may considerably pollute the environment, as well as significantly reduce the mechanical characteristics of the adjoining structures. This reduction in the mechanical characteristic of the adjoining structures can give rise to a de-lamination phenomena, i.e., a detachment of the fiber sheets in the vicinity of the cutting line.

Therefore, when a pyrotechnic cutting device presently has to be integrated into a non-metallic structure, a metallic structure is interposed between the two structural elements to be separated and the cutting of the two structural elements using a pyrotechnic expansion tube is controlled. In other words, separation is ensured by cutting one or more metallic parts joined to the assembly of two structural elements made from non-metallic material and which two structural elements to be separated. This conventional arrangement makes the cutting more complicated and increases costs.

The interposing of the metallic structure between the two non-metallic structural elements to be separated is contrary to one of the essential advantages brought about by non-metallic materials, i.e., savings in weight. Thus, the addition of metallic parts in the linking zone between the assembly of the two structural elements to be separated leads to a non-negligible weight increase. This weight increase is mainly due to the metallic character of the added parts and the need for fixing members to ensure the connection between the metallic parts and the non-metallic parts. This is a particularly prejudicial disadvantage in certain applications, such as in the space industry.

Moreover, the pyrotechnic cutting of metallic parts leads to the production of a relatively severe shock. This shock is applied to the often very sensitive instruments and equipment located in the vicinity. However, if direct cutting of the non-metallic material by a pyrotechnic expansion tube were possible, the very different mechanical characteristics of non-metallic materials would permit, separation while producing a much lower shock level. This would constitute an advantage for the possibly sensitive instruments and equipment located in the vicinity.

SUMMARY OF THE INVENTION

The present invention relates to a pyrotechnic cutting device for directly cutting non-metallic material parts, and in particular composite material parts, using a pyrotechnic expansion tube, while advantageously maintaining the mechanical properties of the non-metallic and/or composite material parts before and after cutting thereof and while limiting the pollution produced during cutting.

According to the present invention, the maintenance of the mechanical properties of the non-metallic and/or composite material parts before and after cutting thereof and the limiting of pollution are obtained by means of a pyrotechnic cutting device. The pyrotechnic cutting device includes a pyrotechnic expansion tube, installed in a space formed between two parts and defined by at least one spacer linking the two parts, so as to cut at least one of the parts along at least one cutting line when the pyrotechnic expansion tube is used, characterized in that each part to be cut is made from a non-metallic material. A cutting member being interposed between the two parts to be cut and the pyrotechnic expansion tube.

The cutting member interposed between the part or parts to be cut and the pyrotechnic expansion tube behaves like a single shear or a punch during the firing of the detonating fuse. Thus, to be cut clean, well localized cutting is ensured, without machining the parts to be cut. Therefore, the mechanical strength of the parts to be cut, prior to cutting, is not cast into doubt. Moreover, the cleanness of the cut preserves the integrity of the parts to be cut, after cutting and greatly limits pollution.

By making it possible directly cut the non-metallic and/or composite material, the parts cutting device, according to the present invention, allow for significant reduction in the weight of the non-metallic assemblies, which previously required interposing a metallic structure for the non-metallic parts to be cut using a pyrotechnic expansion tube. The cutting device, according to the present invention, also makes it possible to significantly reduce the shock produced during cutting of non-metallic parts as compared with the shock produced during the cutting of metallic parts.

In a first embodiment of the present invention, each cutting member includes a cutting edge adjacent to the spacer and extending along the cutting line. The cutting member then behaves like a single shear or a pair of shears.

According to a second embodiment of the present invention, each cutting member includes two opposite cutting edges, wherein a first of the two cutting edges is adjacent to the spacer. The two cutting edges are then able to cut a strip out of the part to be cut, the strip being cut along two substantially parallel cutting lines. In this case, the cutting member behaves like a pair of shears or shears.

According to a third embodiment of the present invention, each cutting member includes at least one projecting cutting edge, which is in contact with the part to be cut along the cutting line. The cutting member then behaves like a punch.

Each cutting member is advantageously made from a substantially non-deformable material entirely housed within the space in which the pyrotechnic expansion tube is installed. The cutting member then behaves like a single shear or a rigid punch.

As a variant, each cutting member can also be made from a deformable material linked with the part to be cut. Each cutting member is then prolonged in moving away from the spacer. In this case, the cutting member behaves like a single shear or a deformable punch.

In order to further improve the localization and cleanness of the cut, an abutment is advantageously fixed to each part to be cut, wherein the abutment is located opposite to and facing the spacer, so that one edge of the abutment extends along the cutting line. The abutment then behaves like an anvil, on which the part to be cut is supported during cutting.

In order to better preserve the integrity of the cut part and more particularly oppose the de-lamination thereof in the case of a composite material part, a deformable material maintaining member is preferably fixed to each part to be cut. The deformable material maintaining member is located opposite to and facing the cutting member. The maintaining member then includes an edge along which the cutting line extends and the maintaining member moves away from the edge, for a prolonged distance.

When the cutting device includes a cutting member, an abutment, and a maintaining member, the three members can be made from the same material as the part to be cut and the material is advantageously a composite material formed from layers of long fibers embedded in a resin matrix. The assembly of the three members is then produced directly by lamination the three members together during the manufacture of the part to be cut.

Moreover, the parts to be cut and the spacer can be made from the same non-metallic material in monolithic form. In other words, the pyrotechnic expansion tube is then integrated into the assembly during the manufacture of the parts.

Conversely, the spacer can be fixed between the parts to be cut by fixing means, such as bolts, traversing the spacer.

All the shapes and constructional variants of the present invention are applicable both when only one of the two parts is to be cut and when both parts are to be cut.

In the case where only one of the two parts is to be cut, the part, which is not to be cut is a substantially non-deformable support part, and is connected to the part to be cut by one or two spacers.

In the case where both parts are to be cut, the space, in which the pyrotechnic expansion tube is housed is defined by two spacers, and a cutting member is placed between the tube and each of the parts to be cut. When the cutting member constitutes a single shear, the second spacer is then fixed between the parts to be cut at a location remote from the pyrotechnic expansion tube.

Conversely, when each cutting member constitutes a pair of shears, the two spacers are fixed between the parts in the vicinity of the cutting member.

BRIEF DESCRIPTION OF THE DRAWING FIGURES

The present invention is described in greater detail hereinafter relative to non-limitative embodiments and the attached drawings, wherein show:

Figure 1:
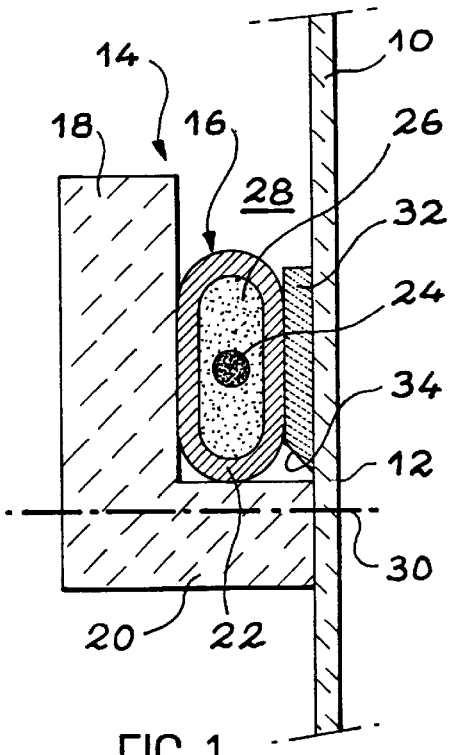
FIG. 1 is a cross-sectional view diagrammatically showing a pyrotechnic cutting device according to the present invention, in the case where a single non-metallic part is to be cut and where the cutting member is in the form of a single shear.
Figure 4A:
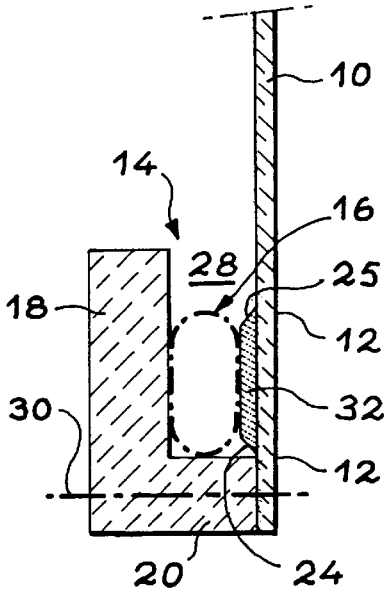
Figure 4B:
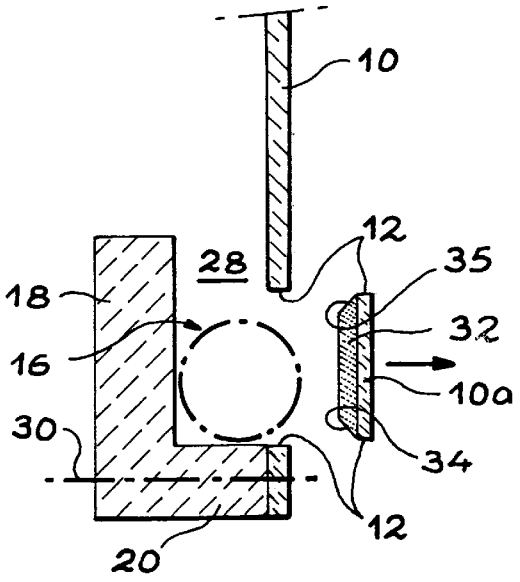
Figure 5A:
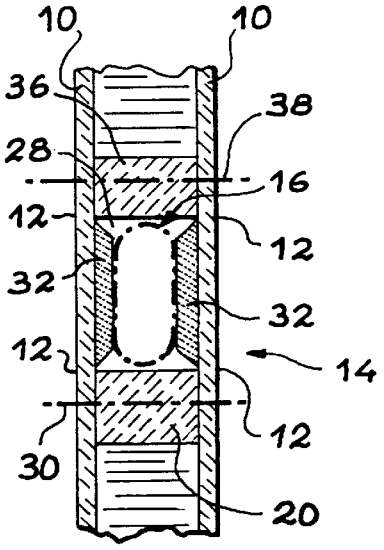
Figure 5B:
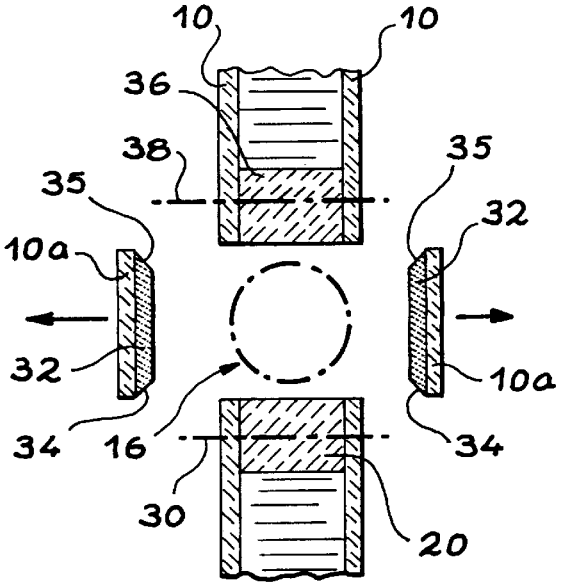
Figure 6:
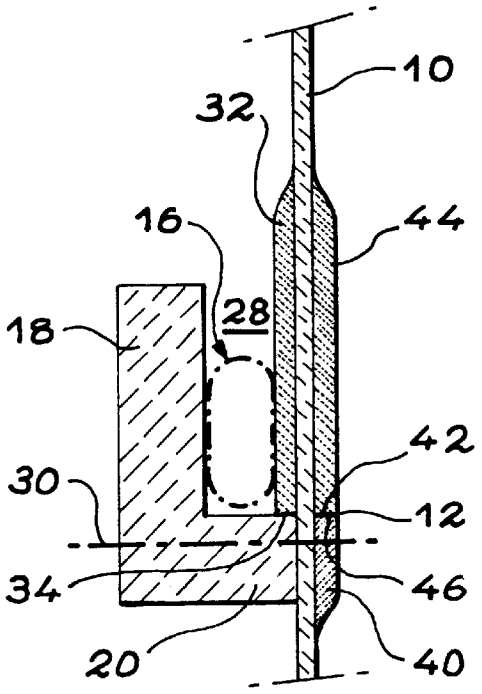
Figure 7:
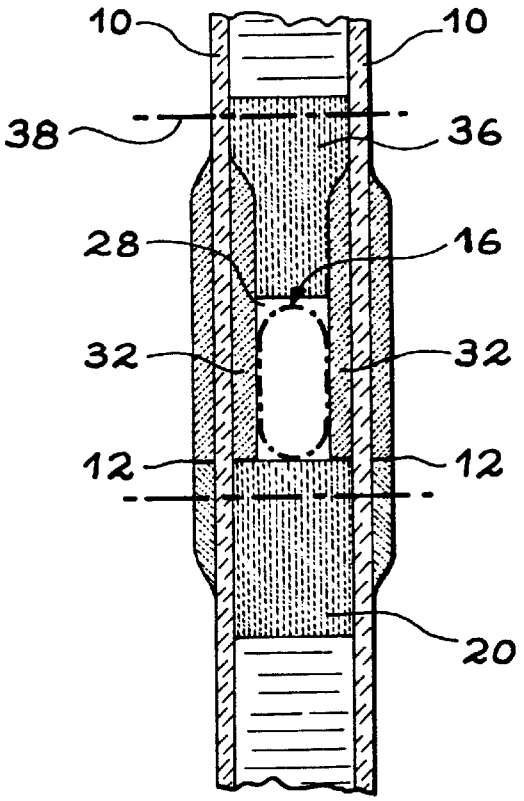

FIGS. 4A and 4B diagrammatic cross-sectional views illustrating a cutting device according to the present invention, in the case of cutting a single non-metallic part by means of a cutting member of the double shear type, before and after cutting, respectively;

FIGS. 5A and 5B diagrammatic cross-sectional views showing a cutting device according to the present invention, in the case where two non-metallic parts are simultaneously cut by two cutting members forming a double shear;

FIG. 6 is a diagrammatic cross-sectional view illustrating a variant of the embodiment of FIG. 1, in the case where the cutting member is deformable and where the device also includes an abutment and a maintaining member, and;

FIG. 7 is a cross-sectional view comparable to FIG. 6, in the case where the cutting device ensures the simultaneous cutting of two non-metallic parts.

DETAILED DESCRIPTION OF THE PREFERRED EMBODIMENTS

In FIG. 1, reference numeral 10 designates a nonmetallic material part, which is to cut along the cutting line 12. The non-metallic material, from which part 10 is formed, can be of different natures without passing outside the scope of the present invention. A preferred application concerns the case where the material is a composite material, formed from sheets of long fibers embedded in a resin matrix. As is well known to the expert, such parts can be obtained by covering sheets of fibers impregnated with thermosetting resin, followed by the polymerization of the resin.

In addition, the part 10 to be cut can be in various forms without passing beyond the scope of the present invention. In the case illustrated in FIG. 1, the part 10 is in the form of a plate having a substantially uniform thickness. The plate can be planar, inwardly curved, or have any other shape adapted to the envisaged application.

The observations, made in connection with the part 10, also apply to the cutting line 12. In other words, the cutting of part 10 can take place along a straight, curved, or other line, without passing outside the scope of the present invention.

In FIG. 1, the cutting device, according to the present invention is designated in general terms by the reference 14. In the case of a pyrotechnic expansion tube 16, the cutting device 14 includes a support part 18 and a spacer 20 (whereby the support part 18 and the spacer 20 can be separate or in one piece, in the manner shown).

The pyrotechnic expansion tube 16 is produced in the same way as the cutting devices 14 used for the cutting of metallic parts. However, the pyrotechnic expansion tube 16 has reduced dimensions adapted to the nature of the material constituting the part 10 to be cut, so as to produce a much lower shock wave than in the cutting devices 14 for metallic parts. Therefore, a detailed description of the pyrotechnic expansion tube 16 is unnecessary.

To facilitate understanding, it is simply pointed out that the pyrotechnic expansion tube 16 includes a tight, deformable, metallic envelope 22, a detonating fuse or cord 24 housed in the envelope 22, and a flexible material 26 interposed between the detonating fuse 24 and the envelope 22. The essential function of the flexible material 26 is to center the detonating fuse within the envelope. The flexible material 26 can be made from, for example silicone rubber. Prior to firing, the envelope 22 has an oblong cross-section, e.g. in the form of a flattened circle or oval, as shown in FIG. 1.

The pyrotechnic expansion tube is received in a space 28 formed between the part 10 to be cut and the support part 18. The said space 28 is defined on one side by the spacer 20. More specifically, the greatest length section of the envelope 22 is oriented parallel to the direction defined by the part 10 to be cut.

In the embodiment illustrated in FIG. 1, the support part 18 and spacer 20 form a part separate from the part 10 to be cut. This single part (i.e., the support part 18 and the spacer 20) is fixed to the part 10 to be cut by fixing means, such as bolts not shown, whose location is diagrammatically illustrated by the dot and dash line 30.

The nature and thickness of the materials constituting the support part 18 and spacer 20 are such that these two parts are substantially non-deformable during the operation of the pyrotechnic expansion tube 16. This result is obtained either by using non-deformable materials of limited thickness, such as metals, or by using relatively flexible, but thicker materials, such as non-metallic materials. In the case of using flexible materials, it should be noted that as a variation, the support part 18 and spacer 20 can be made in one integral piece with the part 10 to be cut. Then there is no need for a fixing means such as the bolts.

In all cases, the face of the support part 18, which is turned towards the part 10 to be cut constitutes a substantially non-deformable surface, which is generally parallel to the part 10 to be cut and on which the pyrotechnic expansion tube 16 is supported, during the firing of the detonating fuse 24. Therefore, the expansion of the envelope 22 entirely takes place in the direction of the part 10 to be cut.

In addition, the face of the spacer 20, which is turned towards the space 28, is aligned with the cutting line 12 of part 10 to be cut.

According to the present invention, a cutting member 32 is also placed in the space 28, between the pyrotechnic expansion tube 16 and the part 10 to be cut. This cutting member 32 takes the form of a plate, which adopts the shape of the part 10 to be cut at a portion thereof adjacent to the spacer 20. In the embodiment illustrated in FIG. 1, the cutting member 32 is substantially non-deformable. Thus, the cutting member 32 is made from a rigid material, such as a metal.

It should be noted that the cumulative thickness of the pyrotechnic expansion tube 16 and the cutting member 32 both located within the space 28, is substantially equal to the width of the space 28, between the part 10 to be cut and the support part 18. An element not shown can be joined to the support part 18, or directly formed thereon in order to close the space 28 opposite the spacer 20, if necessary to prevent the release of the pyrotechnic expansion tube 16 and the cutting member 32.

In the embodiment illustrated in FIG. 1, the cutting member 32 behaves in the manner of a single shear with respect to the part 10 to be cut. Therefore, the cutting member 32 has a cutting edge 34 adjacent to the spacer 20 and extending along the cutting line 12 of the part 10 to be cut. The cutting edge 34 can be straight, bevelled, etc., without passing outside the scope of the present invention. The cutting edge 34 defines a sharp edge with the face of the cutting member 32 in contact with the part 10 to be cut, so that a shear effect is obtained along the cutting line 12, during the operation of the pyrotechnic expansion tube 16.

When the detonating fuse 24 is fired, the resulting shock wave brings about the expansion of the envelope 22, which tends to assume a substantially circular cross-section. In view of the fact that the pyrotechnic expansion tube 16 is supported on a substantially non-deformable support part 18, the expansion of the pyrotechnic expansion tube essentially occurs in the direction of the part 10 to be cut. The force of the expansion is consequently totally applied to the cutting member 32, which transmits the force to the part 10 to be cut, while directing and localizing the cut precisely along the previously defined cutting line 12. Furthermore, the cutting member 32 makes it possible to increase cutting by re-transmitting the pyrotechnic energy to the part 10 to be cut using the cutting edge 34.

Thus, there is a clearly defined and perfectly localized cutting of the non-metallic material part 10 to be cut. In addition, the cut is relatively clean.

In this embodiment, cutting essentially takes place by shearing, which limits pollution. Moreover, such cutting by shearing requires relatively low pyrotechnic energy levels in the case of a non-metallic material part and more particularly, a composite material part.

Figure 2:
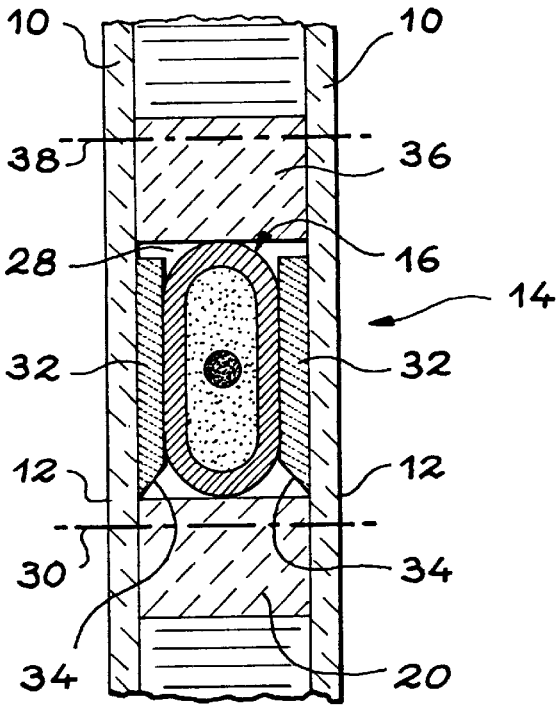
FIG. 2 is a diagrammatic cross-sectional view comparable to FIG. 1, showing a cutting device according to the present invention, applied to the simultaneous cutting of two non-metallic parts, with the aid of two cutting members of the single shear type.

FIG. 2 shows a variation of the first embodiment of the present invention described hereinabove in conjunction with FIG. 1. This variation relates to the case where the pyrotechnic cutting device is used for simultaneously cutting two substantially parallel parts 10 to be cut, which two parts 10 to be cut define a space 28 therebetween. In this case, the space 28 is closed, opposite the spacer 20, e.g. by a second spacer 36. The second spacer 36 is fixed to the parts 10 to be cut by fixing means, such as bolts (not shown). The location of the mixing means is diagrammatically illustrated by the dot and dash line 38 in FIG. 2.

It should be noted that as a variation, the spacer 36 can be in one integral piece with the two parts 10 to be cut or the spacer 36 can be replaced by the direct junction of the two parts, which are then joined to one another.

In the constructional variant of FIG. 2, the space 28 contains both the pyrotechnic expansion tube 16 and two cutting members 32 interposed between the pyrotechnic expansion tube 16 and each of the parts 10 to be cut.

In the embodiment illustrated in FIG. 2, the two cutting members 32 are in the form of single shear, designed for simultaneously cutting the two parts 10 to be cut along cutting lines 12 aligned with the face of the spacer 20 turned towards the space 28. Therefore, each of the cutting members 32 has a cutting edge 34 adjacent to the spacer 20 and extending along the cutting line 12 of the corresponding part 10 to be cut.

It should be noted that the localization of the cut along the cutting lines 12 is all the more effective if the portions of the parts 10 to be cut, which are in contact with the cutting members 32, easily bend towards the outside, while pivoting about their anchoring point illustrated by the dot and dash lines 38 in FIG. 2. Therefore the fixing of the parts 10 to be cut and the spacer 36 should be as far away as possible from pyrotechnic expansion tube 16 and the cutting lines 12 provided in the parts 10 to be cut. Conversely, as in the embodiment of FIG. 1, it is desirable for the fixing of the parts 10 to be cut and the spacer 20, the location of which is illustrated by the dot and dash lines 30, to be as close as possible to the cutting lines 12.

In the case of the variation of FIG. 2, the cutting members 32 are substantially non-deformable and freely placed in the space 28, similar to the embodiment described relative to FIG. 1.

Figure 3:
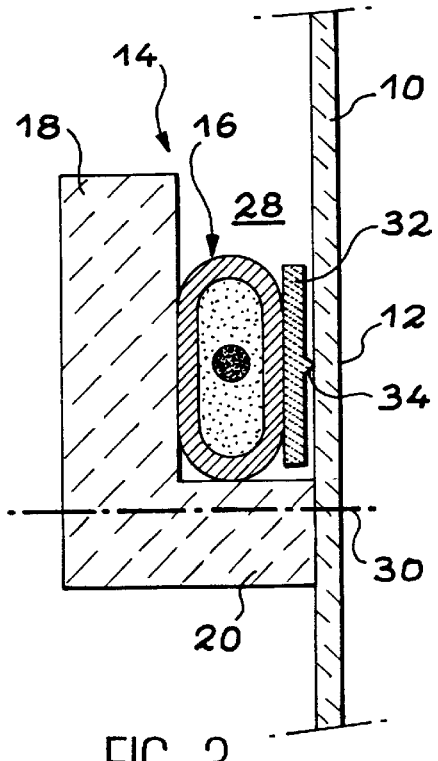
FIG. 3 is a cross-sectional view comparable to FIG. 1, illustrating the case of cutting a single non-metallic material part by means of a cutting member forming a punch.

FIG. 3 diagrammatically shows a second embodiment of a pyrotechnic cutting device 16 according to the present invention. As in the case of FIG. 1, FIG. 3 illustrates the simplest case where the cutting applies to a single part 10 to be cut. Thus, the general arrangement is comparable to that described relative to FIG. 1, so that a detailed description of the different parts here constituting the cutting device 14 is unnecessary.

Compared with the first embodiment described relative to FIG. 1, the second embodiment of the present invention illustrated in FIG. 3, differs essentially through the form or shape of the cutting member 32. Thus, instead of being designed as a single shear, the cutting member 32 now behaves like a punch. Thus, the cutting member 32 has a projecting cutting edge 34, e.g., having a V-shaped or pointed cross-section, on its face turned towards the part 10 to be cut. An end of the cutting edge 34 is in contact with the part 10 to be cut, in accordance with the cutting line 12 provided in the part 10 to be cut.

In the embodiment illustrated in FIG. 3, the cutting member 32 is a non-deformable member, as in the case of FIG. 1.

The projecting cutting edge 34 can be located at varying distances from the spacer 20, so that cutting then takes place along a cutting line 12 spaced from the surface of the spacer 20 and facing towards the space 28. When the distance between the projecting cutting edge 34 and the spacer 20 increases, the cutting operation is moved, but the shearing operation is not. Bearing in mind the advantages resulting from the shearing during the cutting of a composite material part (i.e., reduction of the energy necessary for cutting and reduction of pollution), there is every interest in placing the projecting cutting edge 34 as close as possible to the spacer 20.

It should be noted that the two cutting members 32, used in order to simultaneously cut the two parts 10 to be cut in the variation of FIG. 2 can be implemented in accordance with the second embodiment of the present invention, i.e., in the form of punches having a projecting cutting edge 34. In this case, the projecting cutting edge is also as near as possible to the spacer 20 and as far removed as possible from the spacer 36.

FIGS. 4A and 4B show a third embodiment of the present invention, applied to the cutting of a single part 10 to be cut. The arrangement is essentially comparable to that described hereinabove relative to FIG. 1. The essential difference relates to the cutting member 32, which here behaves like a pair of shears.

More specifically, in this third embodiment of the present invention, the cutting member 32 is a non-deformable member, e.g. metallic member, in the form of a plate and able to cut the part 10 to be cut simultaneously along two cutting lines 12 using its cutting edge 34 adjacent to the spacer 20 and using its cutting edge 35 opposite to and parallel to the cutting edge 34. The width of the cutting member 32 between its cutting edges 34 and 35 is then relatively small, so that the same shearing effect can be obtained during the expansion of the pyrotechnic expansion tube 16 caused by the firing of its detonating fuse.

To facilitate the double cutting of part 10 to be cut, the latter can also have a reduced rigidity in the region located between the two cutting lines 12, if the mechanical characteristics required prior to cutting permit this.

As has been illustrated in FIG. 4B, the operation of the pyrotechnic expansion tube 16 then has the effect of simultaneously cutting the part 10 to be cut along the two cutting lines 12, which leads to the ejection of a strip 10*a* of part 10 to be cut, the strip 10*a* being defined between the two cutting lines 12.

FIGS. 5A and 5B illustrate the application of the third embodiment of the present invention to the simultaneous cutting of two parts 10 to be cut.

The arrangement is then comparable to that described hereinabove with reference to FIG. 2, i.e., a cutting member 32 is interposed between the pyrotechnic expansion tube 16 and each of the parts 10 to be cut. Moreover, the cutting members 32 are implemented in a comparable manner to that described with reference to FIGS. 4A and 4B.

In the case of FIGS. 5A and 5B, the cutting device 14 also has a symmetry with respect to a median plane of the pyrotechnic expansion tube 16, oriented perpendicular to the two parts 10 to be cut. In other words, the spacer 36 is installed and fixed between the parts 10 to be cut in the vicinity of the cutting edges 35 of the cutting members 32, in such a way that the cutting edges 35 are adjacent to the face of the spacer 36 facing towards the space 28 and extending along the corresponding cutting lines 12.

As shown in FIG. 5B, the operation of the pyrotechnic expansion tube 16 then leads to the simultaneous double cutting of each of the parts 10 to be cut and the ejection of a strip 10*a* cut therefrom.

FIG. 6 shows another variation of the first embodiment, applied to the cutting of a single part 10 to be cut.

Essentially, the arrangement illustrated in FIG. 6 has the same characteristics as described in conjunction with FIG. 1.

A first difference is that instead of being produced from a substantially non-deformable material, the cutting member 32 is made from a deformable material, which is preferably identical or very close to the non-metallic material from which the part 10 to be cut is made.

Thus, when the part 10 to be cut is made from a composite material formed from sheets of long fibers embedded in a resin matrix, the cutting member 32 can be obtained by covering supplementary layers of thermosetting resin-impregnated fibers. The cutting member 32 is then linked to the part 10 to be cut over an entire surface of the cutting member 32 is adjacent thereto, during the manufacture of the part 10 to be cut.

In this case, the orientation of the fibers in the cutting member 32 can significantly differ from that of the fibers located in the part 10 to be cut, in order to take account of the specific function of the cutting member 32. Thus, the fibers in the cutting member 32 are advantageously interlaced, in order to ensure that the radial forces applied thereto during the operation of the pyrotechnic expansion tube 16 are take up. Conversely, the fibers placed in the part 10 to be cut are generally largely oriented in the longitudinal direction, so as to ensure the transmission of the forces or stresses mainly applied thereto in longitudinal direction.

When the cutting member 32 is made from a deformable material, as illustrated in FIG. 6, a cutting edge 34 thereof adjacent to the spacer 20, is substantially in contact therewith. Moreover, the cutting member 32 is moves away from the cutting edge 34 over a certain distance.

FIG. 6 also shows two improvements to the cutting device 14 according to the present invention. It should be noted that these improvements can be used in any of the embodiments and variations described hereinbefore.

According to a first of the improvements illustrated in FIG. 6, an abutment 40 is fixed to the part 10 to be cut, wherein the abutment 40 faces and is opposite to the spacer 20. This abutment 40 is in the form of a plate, wherein an edge 42 of the plate extends along the cutting line 12 of the part 10 to be cut.

The abutment 40 can be made from a substantially non-deformable material, such as a metal. However, in the embodiment illustrated in FIG. 6, the abutment 40 is made from the same non-metallic material as that of which the part 10 to be cut is formed. Like the cutting member 32, the abutment 40 can then be integrated into the part 10 to be cut during manufacture, particularly when the part 10 to be cut is made from a composite material.

The fixing means (not shown), having a location illustrated by the dot and dash line 30, effectively maintains the abutments 40 against the part 10 to be cut, in the vicinity of the cutting line 12.

The presence of the abutment 40 makes it possible to further improve the localization and precision of the cut, by acting like an anvil, which supports the part 10 to be cut.

According to a second improvement illustrated in FIG. 6, a maintaining member 44 is also fixed to the part 10 to be cut, opposite to and facing the cutting member 32. The maintaining member 44 includes an edge 46 extending along the cutting line 12. The edge 46 of the maintaining member 44 is substantially in contact with the edge 42 of the abutment 40, when an abutment 40 exists.

The maintaining member 44 is made from a deformable material, in order to follow the deformation of the part 10 to be cut during a cutting operation using of the pyrotechnic expansion tube 16. Like the cutting member 32 in the embodiment of FIG. 6, the maintaining member 44 extends over a certain distance opposite its edge 46.

The maintaining member 44 is advantageously made from a material identical to that of which the part 10 to be cut is formed. In the case where the part 10 to be cut is a composite material, the maintaining member 44 can consequently be directly integrated into the part 10 to be cut during manufacture, in the same way as the cutting member 32 and abutment 40 in the embodiment illustrated by FIG. 6.

The functions of the maintaining member 44 are to maintain the integrity of the corresponding portion of part 10 and to absorb shocks during cutting. The maintaining member 44 thus further improves the cleanness of cutting. More particularly, in the case of a composite material, the maintaining member 44 maintains the integrity of the adjacent portion of the part 10 to be cut following cutting, while opposing de-lamination.

FIG. 7 shows a pyrotechnic cutting device 14 comparable to that described relative to FIG. 6 and applied to the simultaneous cutting of two parts 10 to be cut.

In this case, the cutting members 32 and the maintaining members 44 associated with the parts 10 to be cut are fixed to a spacer 36 by fixing means, such as bolts (not shown), wherein the location of the fixing means is illustrated by the dot and dash lines 38 and while respecting the same conditions as those described hereinabove relative to FIG. 2. More specifically, the fixing of the parts 10to be cut, cutting members 32, and maintaining members 44 to the spacer 36 takes place at a location 38 relatively remote from the pyrotechnic expansion tube 16 and cutting lines 12 adjacent to the spacer 20. This characteristic facilitates the bending of the parts 10 to be cut by pivoting about the aforementioned fixing means, necessary for a good cutting by shearing, of the two parts 10 to be cut along the spacer 20.

In general terms, the pyrotechnic cutting device 14 according to the present invention makes it possible, in all cases, to directly cut one or two non-metallic material parts and in particular, composite material parts, according to one or more clearly defined and well localized cutting lines, under generally satisfactory cleanness conditions.

It should be noted that the simultaneous cutting of two parts is preferable whenever possible, due to the resulting perfect symmetry of the cutting device. Thus, the energy required for cutting is then of a minimum nature.

In all cases, the cutting of non-metallic material parts is ensured, while maintaining the mechanical strength thereof, prior to cutting, as a result of the absence of machining. Moreover, the direct cutting of non-metallic materials leads to a significant reduction in the energy required for cutting, compared with the prior art procedure, in which intermediate metallic parts were cut. Consequently the shock produced by cutting is very significantly reduced, which is an important advantage with respect to any installation and equipment which may be located in the vicinity of the cutting device.

Finally, when the cutting device includes two pairs of parts to be cut and a single cutting operation takes place (FIG. 2), the cutting lines can be aligned with the same spacer 20, as shown, or aligned with each of the spacers 20 and 36.

What is claimed is:

1. A pyrotechnic cutting device for cutting non-metallic materials comprising:

a pyrotechnic expansion tube including a pyrotechnic member within a flexible material which is surrounded by an outer deformable metallic tube tightly fit within a space between a spacer, and a cutting member, a non-metallic material to be cut, said cutting member being interposed between the non-metallic material part to be cut and said pyrotechnic expansion tube, whereby forces created by said pyrotechnic expansion tube as it expands are transferred to a cutting edge of said cutting member to cut through the part to be cut at a cutting line.

2. The device according to claim 1, wherein said cutting edge of said cutting member is located adjacent to said spacer extends along the cutting line.

3. The device according to claim 1, further comprising another cutting edge located at a position opposed to said cutting edge of said cutting member which is located adjacent to the spacer for cutting a strip from the part to be cut, along the cutting line and another cutting line.

4. The device according to claim 1, wherein said cutting edge of said cutting member is a projecting cutting edge, in contact with the part to be cut along the cutting line.

5. The device according to claim 1, wherein said cutting member is made from a substantially non-deformable material totally housed in the space.

6. The device according to claim 2, wherein said cutting member is made from a deformable material, linked with the part to be cut so as to take a prolonged amount of time to move away from the spacer.

7. The device according to claim 6, further comprising an abutment fixed to the part to be cut, opposite to and facing the spacer, in such a way that one edge of said abutment extends along the cutting line.

8. The device according to claim 7, further comprising a maintaining member made from a deformable material, said maintaining member being fixed to the part to be cut, opposite to and facing said cutting member, said maintaining member including an edge extending along the cutting line and said maintaining member taking a prolonged amount of time to move away from said edge.

9. The device according to claim 8, wherein said cutting member, said abutment, and said maintaining member are made from a same non-metallic material as the part to be cut the material being a composite material formed from sheets of long fibers embedded in a resin matrix.

10. The device according to claim 1, wherein the part to be cut and the spacer are made from a same non-metallic material in monolithic form.

11.The device according to claim 1, wherein the spacer is fixed between the part to be cut and another part to be cut by fixing means traversing them.

12. The device according to claim 1, further comprising a second part connected to the part to be cut by the spacer, wherein the second part is a substantially non-deformable support part.

13. The device according to claim 2, wherein the part to be cut is connected to another part to be cut by the spacer and a second spacer which help define the space in which the pyrotechnic expansion tube and said cutting member are placed.

14. The device according to claim 13, wherein the second spacer is fixed between the parts to be cut at a location remote from said pyrotechnic expansion tube.

15. The device according to claim 13, further including a second cutting member such that said cutting member and said second cutting member are placed between the pyrotechnic expansion tube and one of the parts to be cut.

16. The device according to claim 15, wherein the spacer and the second spacer are fixed between the parts to be cut in a vicinity of said cutting member and the second cutting member, respectively.

* * * * *